US007056581B2

(12) United States Patent
Zhou et al.

(10) Patent No.: US 7,056,581 B2
(45) Date of Patent: Jun. 6, 2006

(54) HIGH-STRENGTH THIN SHEATH FIBERS

(75) Inventors: Qiang Zhou, Midlothian, VA (US); Herman L. Lanieve, Warren, NJ (US); Jeffrey T. Perkins, Richmond, VA (US); Conor Twomey, Midlothian, VA (US)

(73) Assignee: Performance Fibers, Inc.

( * ) Notice: Subject to any disclaimer, the term of this patent is extended or adjusted under 35 U.S.C. 154(b) by 0 days.

(21) Appl. No.: 10/186,831

(22) Filed: Jul. 1, 2002

(65) Prior Publication Data

US 2003/0087092 A1 May 8, 2003

Related U.S. Application Data

(60) Provisional application No. 60/303,102, filed on Jul. 3, 2001.

(51) Int. Cl.
*D02G 3/00* (2006.01)

(52) U.S. Cl. ..... 428/373; 428/372; 428/374

(58) Field of Classification Search ..... 428/373, 428/372, 374
See application file for complete search history.

(56) References Cited

U.S. PATENT DOCUMENTS

| | | | | |
|---|---|---|---|---|
| 3,658,634 | A * | 4/1972 | Yanagi et al. | 428/373 |
| 3,725,192 | A * | 4/1973 | Ando | 428/373 |
| 3,849,044 | A * | 11/1974 | Ando et al. | 425/131.5 |
| 4,415,726 | A * | 11/1983 | Tanji et al. | 528/272 |
| 4,756,969 | A * | 7/1988 | Takeda | 428/372 |
| 5,153,066 | A | 10/1992 | Tanaka et al. | 428/373 |
| 5,505,889 | A | 4/1996 | Davies | 264/173.16 |
| 5,533,883 | A | 7/1996 | Hodan et al. | 425/131.5 |
| 5,562,930 | A | 10/1996 | Hills | 425/198 |
| 5,618,479 | A | 4/1997 | Lijten et al. | 264/103 |
| 5,985,961 | A | 11/1999 | Dailey et al. | 524/100 |
| 6,413,635 | B1 * | 7/2002 | Martin et al. | 428/372 |
| 6,703,122 | B1 * | 3/2004 | Zhou et al. | 428/370 |
| 2003/0087092 | A1 * | 5/2003 | Zhou et al. | 428/373 |

* cited by examiner

*Primary Examiner*—Jill M. Gray
(74) *Attorney, Agent, or Firm*—Rutan & Tucker, LLP

(57) ABSTRACT

A fiber comprises a core, a sheath, and an additive that determines a desired physico-chemical parameter of the fiber, wherein the fiber is spun such that without increasing the concentration of the additive the desired parameter increases when the volume of the sheath decreases. Especially preferred additives include chromophores (e.g., a UV absorbing agent), flame-retardants, and adhesion promoters.

13 Claims, 3 Drawing Sheets

Core . 50%
Sheath 50%
Additive% (fiber) . 1.5%
Additive% (sheath) : 3 0%
Tenacity retention . 45%

Core . 60%
Sheath · 40%
Additive% (fiber) . 1 5%
Additive% (sheath) · 3.75%
Tenacity retention 50 2%

Core . 70%
Sheath : 30%
Additive% (fiber) 1 5%
Additive% (sheath) 5%
Tenacity retention . 54%

HIGH-STRENGTH THIN SHEATH FIBERS

CROSS-REFERENCE TO RELATED APPLICATIONS

This application claims priority to pending U.S. provisional application Ser. No. 60/303,102, filed Jul. 3, 2001, the entire contents of which are incorporated by reference.

FIELD OF THE INVENTION

The field of the invention is thin sheath fibers.

BACKGROUND OF THE INVENTION

Synthetic fibers are commonly employed in the manufacture of various consumer products. Depending on the particular use, such fibers can be modified with one or more types of additives to impart a desired physico-chemical characteristic. For example, where colored fibers are desired, dyes can be added to the fiber. Alternatively, UV absorbers or flame-retardants can be added to the fiber to render such fibers more resistant to environmental conditions.

There are various processes of adding additives to fibers known in the art. For example, the additive can be applied to a preformed fiber using a single or multiple dip process. Dip coating is particularly advantageous because the coating process is frequently independent of the type and configuration of the fiber. However, several problems tend to arise with dip coating. Among other problems, adhesion of the additive may be less than satisfactory, especially when the fiber is further processed in a weaving, knitting, or other mechanically challenging process. Furthermore, dip coating may modify one or more surface qualities (e.g., lubricity), and are often environmentally problematic. To overcome at least some of the problems associated with coating a fiber, the additive can be admixed with the fiber material. While mixing the additive to the fiber material often alleviates or solves problems with additive adhesion, other difficulties may arise. For example, where additives are distributed across a fiber, large amounts of the additive are typically required to achieve the desired effect provided by the additive. Moreover, relatively large quantities of additives tend to negatively impact desirable physico-chemical properties (e.g., tenacity) of the fiber.

Although various methods are known in the art to improve desirable physico-chemical parameters by providing an additive to a fiber, all, or almost all of them suffer from one or more problems. Thus, there is still a need to provide compositions and methods for production of fibers with improved physico-chemical parameters.

SUMMARY OF THE INVENTION

The present invention is directed to compositions and methods for a fiber comprising a core, a sheath, and an additive that determines a desired physico-chemical parameter of the fiber. Contemplated fibers are spun such that without increasing the amount of the additive, the desired physico-chemical parameter increases when the volume of the sheath decreases.

In one aspect of the inventive subject matter, the physico-chemical parameter at a given amount of additive increases at least 10% when the volume of the sheath decreases 10%, and more preferably increases at least 20% when the volume of the sheath decreases 20%.

In another aspect of the inventive subject matter, the additive is present in the fiber in an amount of between about 0.1 wt % and 10 wt %. Particularly preferred additives comprise a chromophore, preferably a UV absorbing agent or a dye. Further contemplated additives include a flame retardant, and adhesion promoters. Consequently, contemplated desired physico-chemical parameters include retention of tenacity after UV irradiation, color intensity, flame retardation, and improved adhesion. Particularly contemplated fibers include a UV absorbing agent in an amount of about 1.5 wt %, have a core to sheath volume ratio of 50:50, and exhibit retention of tenacity after UV irradiation of no less than 45%. Further particularly contemplated fibers include a UV absorbing agent in an amount of about 1.5 wt %, have a core to sheath volume ratio of 60:40, and exhibit retention of tenacity after UV irradiation of no less than 50%, and still further especially contemplated fibers include a UV absorbing agent in an amount of about 1.5 wt %, have a core to sheath volume ratio of 70:30, and exhibit retention of tenacity after UV irradiation of no less than 54%. Contemplated fibers may have a horizontal cross section in various shapes, including a trilobal shape, a concentric shape, and an eccentric shape.

In a further aspect of the inventive subject matter, a method of fabricating a fiber has one step in which a core material, a sheath material, and an additive are provided, wherein the additive at least partially determines a desired physico-chemical parameter of the fiber. In a further step, a core is formed from the core material, and a sheath having a volume is formed from the sheath material such that the sheath at least partially surrounds the core, wherein the additive is disposed in at least one of the core and the sheath. Contemplated fibers are spun such that the physico-chemical parameter increases without increasing the amount of the additive when the volume of the sheath decreases.

Various objects, features, aspects and advantages of the present invention will become more apparent from the following detailed description of preferred embodiments of the invention, along with the accompanying drawing.

DETAILED DESCRIPTION

The inventors have discovered that a desirable physico-chemical parameter in a thin sheath fiber having a protective additive can be improved by spinning the fiber such that the sheath thickness decreases while the overall amount of the additive in the fiber is maintained.

Figure 1:
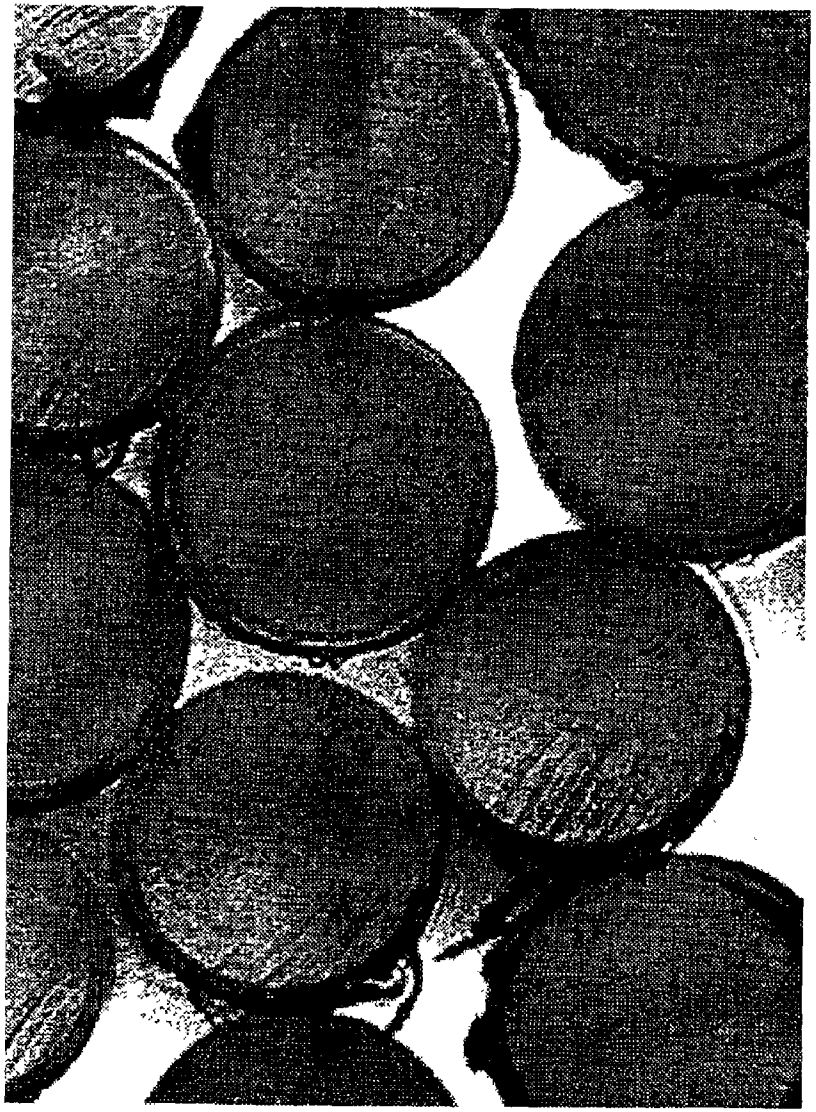
FIG. 1 is a photomicrograph of a cross section of multiple exemplary thin sheath fibers.

In one preferred aspect of the inventive subject matter, contemplated fibers as depicted in FIG. 1 are concentric bicomponent fibers with a core and a sheath surrounding the core (having a core to sheath volume ratio of 85%:15%). The material for core and sheath is preferably poly(ethylene terephthalate), wherein the sheath material further comprises an ultraviolet light (UV) absorbing agent (e.g., a benzotriazole, or a cyclic iminoester) in an amount of about 1.5 wt %. It is still further preferred that such fibers have a volume ratio between core and sheath of at least 50:50, more preferably of at least 60:40, even more preferably of at least 70:30, and most preferably of at least 80:20. Preferred fibers will have a retention of tenacity after UV irradiation of no less than 45%, more preferably no less than 50, and even more preferably of no less than 54% (e.g., see examples).

In alternative aspects, contemplated fibers need not necessarily be restricted to concentric bicomponent fibers with a core and a sheath surrounding the core, and alternative fibers include multi-component fibers with three or more components. Furthermore, it should be appreciated that the configuration of suitable fibers may vary considerably, and alternative configurations particularly include trilobal configurations and eccentric configurations. For example, where it is especially desirable that contemplated fibers have a multi-component structure, or multiple sheaths surrounding one core may be appropriate. On the other hand, where fibers with non-circular horizontal cross section are desired, suitable fibers may have a crenulated, bilobal, or trilobal configuration. Moreover, it is contemplated that the volume ratio of core to sheath may vary, and that numerous volume ratios are considered suitable, including volume ratios of about 50%–50% (core volume to sheath volume) to approximately 95%–5% (core volume to sheath volume).

Furthermore, the material for both core and sheath may vary considerably, and all known polymeric materials, and particularly melt-extrudable materials, for fiber production are considered suitable for use in conjunction with the teachings herein. Especially contemplated materials include organic polymers, which particularly include polyesters (e.g., poly(butylene terephthatalate), or poly(ethylene terephthalate)), polyamides (e.g., Nylon 6, or Nylon 66), polyethylene, polypropylene, and other polyolefin materials, and all reasonable combinations thereof. Consequently, the intrinsic viscosity (IV) of suitable polymers may vary considerably However, it is generally preferred that the IV of contemplated polymers is greater than 0.5, more preferably greater than 0.75, and most preferably greater than 0.9.

In further alternative aspects of the inventive subject matter, additives other than UV absorbing agents may be included, and particularly preferred alternative additives include dyes (comprising a single or multiple chromophores), flame retardants (e.g., brominated compounds or other commercially available flame retardants), solid materials (e.g., titanium or other metal flakes), or adhesion promoters (e.g., epoxy group containing agents) to impart a particularly desirable physico-chemical parameter. Consequently, contemplated alternative physico-chemical parameters include color intensity, flame retardation, cutting resistance, and improved adhesion of the fiber to a material (e.g., rubber, or other organic polymer). It should also be appreciated that contemplated fibers may comprise more than one additive to achieve one or more desired physico-chemical effects. For example, a fiber may include a UV absorbing agent and a flame retardant to achieve a UV and flame resistant fiber.

With respect to the concentration of suitable additives in the fiber, it is preferred that the concentration is between about 0.1 wt % and 10 wt %. However, and especially where particularly low concentrations are appropriate, concentrations of 0.1 wt % to 0.005 wt % and less are also suitable. For example, where the additive is a fluorophor with high quantum yield, the fluorophor may have a concentration of 0.01 wt %. On the other hand, where relatively high concentrations of the additives are required or desirable for a particular function, concentrations of 10 wt %–25 wt % and higher are contemplated. For example, where high cutting resistance is especially desired, metal powder may be included in an amount of 20 wt %, and even more. However, it is generally preferred that the fibers are spun such that a desired effect can be achieved by adding lower amounts of the additive to the fiber as compared to fibers that are spun using a prior art process.

Figure 2A:
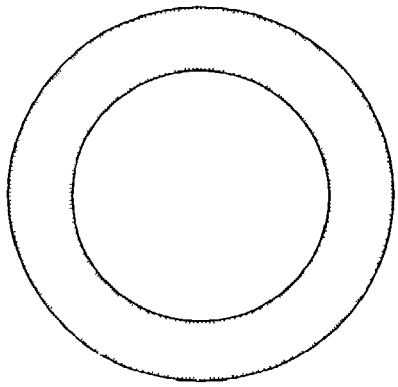
FIGS. 2A–2C are schematics of various exemplary thin sheath fibers.
Figure 2B:
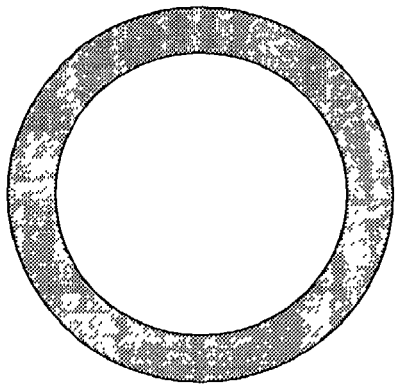
Figure 2C:
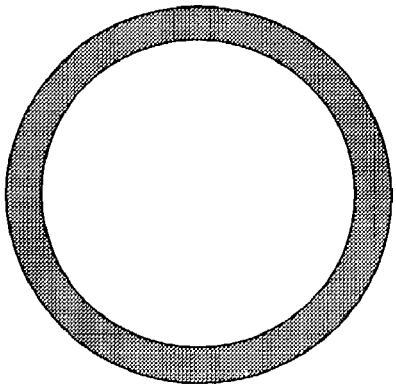

With respect to the location of the additive, it should be recognized that the additive or additives may be disposed in the core and/or the sheath. However, it is especially preferred that a predominant portion (i.e., at least 70% of the total additive) or all of the additive is disposed within the sheath. Consequently, it should be recognized that the local concentration of the additive in the sheath will increase when the volume of the sheath relative to the volume of the core decreases. Thus, the physico-chemical parameter (which is at least partially determined by the additive) of contemplated fibers will increase without increasing the amount of the additive in the fiber when the volume of the sheath decreases, which is schematically illustrated in FIG. 2. For example, it is contemplated that the physico-chemical parameter in such fibers will increase at least 10% when the volume of the sheath decreases 10%, and more preferably the physico-chemical parameter in such fibers will increase at least 20% when the volume of the sheath decreases 20% (see Examples, infra).

In a further particularly contemplated aspect of the inventive subject matter, contemplated fibers are spun from a spin pack comprising a distribution/filtration element with a sheath material conduit, a core material conduit, and a filter at least partially disposed within the sheath material conduit, wherein the sheath material conduit is configured to have a ratio of open volume to sheath material mass flow as indicated below:

| Wt % Sheath | 10 | 20 | 30 | 40 | 50 |
|---|---|---|---|---|---|
| Open Sheath Volume ($cm^3$) | 47.03 | 47.03 | 47.03 | 47.03 | 47.03 |
| Mass flow rate ($cm^3$/min) | 20.16 | 40.32 | 60.48 | 80.64 | 100.80 |
| Ratio of open volume to mass flow | 2.33 | 1.17 | 0.78 | 0.58 | 0.47 |

In a graphical representation, particularly preferred sheath material conduits are configured to have a quotient of [ratio of open volume to sheath material mass flow]/[wt % of the sheath] that lies below the curve (which is represented by the equation $y=23.209x^{-0998}$) as depicted in the graph below:

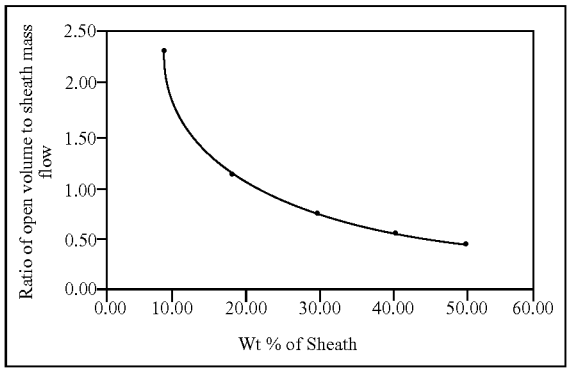

Figure 3:
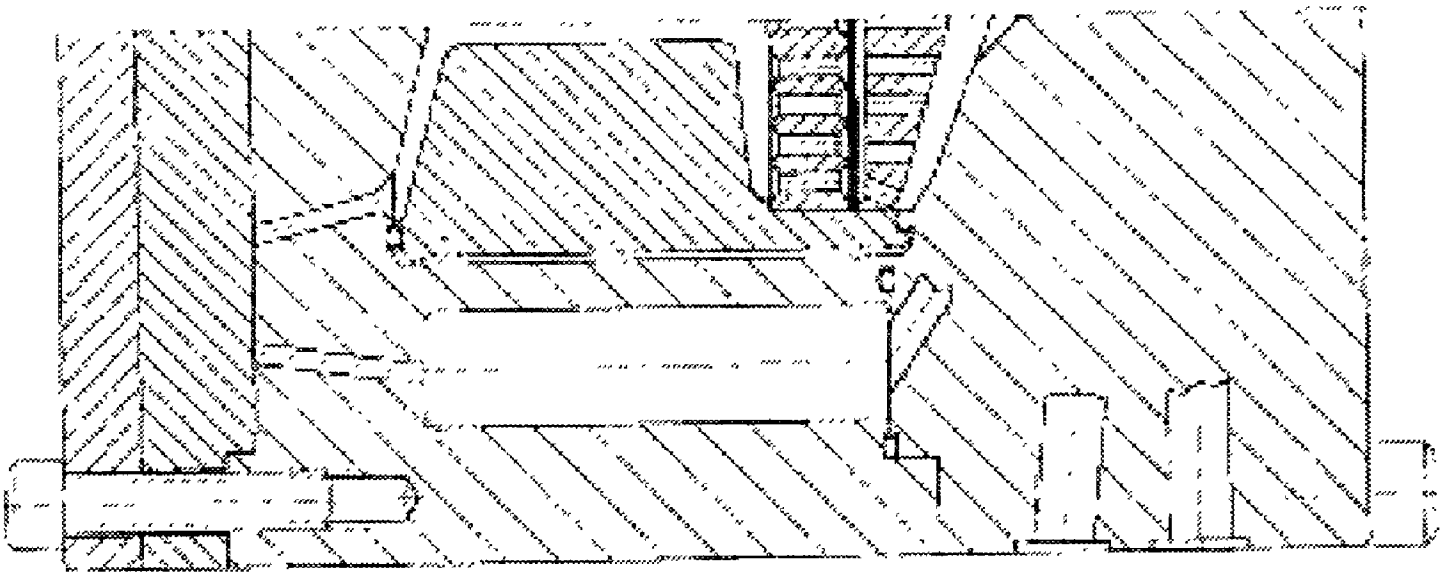
FIG. 3 is a partial schematic of an exemplary sheath material conduit of a spin pack for spinning contemplated thin sheath fibers.

It is still further preferred that at least a portion of the contemplated sheath material conduit has a substantially centered position within the distribution/filtration element. Especially preferred spin packs for production of contemplated fibers are described in copending U.S. Patent Application with the title "High-Strength Chemically Resistant Thin Sheath Fibers and Methods of Manufacture", by Qiang Zhou, Alex Lobovsky, Jim Matrunich, Conor Twomey, and Barbara McGrath, filed Jul. 3, 2001, which is incorporated by reference herein. An exemplary preferred sheath material conduit in a spin pack is depicted in FIG. 3.

However, it is also contemplated that alternative spin packs are suitable for the production of contemplated fibers, so long as such spin packs form a fiber that comprises a core, a sheath that at least partially surrounds the core, and an additive disposed in at least one of the core and the sheath and determining a desired physico-chemical parameter, and so long as the fiber is spun with the spin pack such that without increasing the amount of the additive in the fiber the physico-chemical parameter increases when the volume of the sheath decreases. Consequently, a method of forming a fiber comprises one step in which a core material, a sheath material, and an additive are provided wherein the additive at least partially determines a desired physico-chemical parameter of the fiber. In a further step, the additive is disposed in at least one of the core material and the sheath material, and in a still further step, the fiber is spun such that without increasing an amount of the additive in the fiber the physico-chemical parameter increases when the volume of the sheath decreases. With respect to the core material, sheath material, the additive, and the desired physico-chemical parameter the same considerations as described above apply.

EXAMPLES

Composition and Physico-chemical Properties of Thin Sheath Fibers with UV Absorbing Agent The following fibers were spun from the compositions as indicated in Table 1, which also includes volume ratios and selected physico-chemical properties (here: retention of tenacity after 400 hours of UV exposure). Spinning conditions are as indicated below:

TABLE 1

| | Fiber 1 | Fiber 2 | Fiber 3 | Fiber 4 |
|---|---|---|---|---|
| Core Material | PET of 0.95 IV | PET of 0.95 IV | PET of 0.95 IV | PET of 0 95 IV |
| Sheath Material | PET of 1.02 IV plus UV absorbing compound | PET of 1.02 IV plus UV absorbing compound | PET of 1.02 IV plus UV absorbing compound | PET of 1 02 IV plus UV absorbing compound |
| Core Volume | 50 | 60 | 70 | 70 |
| Sheath Volume | 50 | 40 | 30 | 30 |
| Total wt % of UV Absorbing Agent | 1 5 | 1 5 | 1 5 | 0 0 |
| Wt % of UV Absorbing Agent in Sheath | 3.0 | 3.75 | 5 0 | 0 0 |
| Wt % of UV Absorbing Agent in Core | 0 0 | 0 0 | 0.0 | 0.0 |
| % Tenacity Retention after 400 hrs UV | 45 0 | 50 2 | 54 0 | 25 8 |

The UV absorbing agent was a cyclic iminoester. The UV absorbing agent was compounded with PET of 1.02 IV to produce the above-indicated concentrations of UV absorbing sheath material. In an alternative set of fibers, the overall concentration of UV absorbing agent was decreased in the fiber by 50%, while the sheath to core volume ratio was constant, the percent tenacity retention after 400 hours UV radiation was decreased only by less than 20%. The UV absorbing agent was a benzotriazole. Here, (see e.g., Fiber 6, below) a fiber has a UV absorbing agent present in an amount of about 0.5 wt %, wherein the core and the sheath have a volume ratio of 90:10, and wherein the retention of tenacity after UV irradiation is no less than 41%.

TABLE 2

| | Fiber 5 | Fiber 6 |
|---|---|---|
| Core Material | PET of 0 95 IV | PET of 0 95 IV |
| Sheath Material | PET of 1 02 IV plus UV absorbing compound | PET of 1.02 IV plus UV absorbing compound |
| Core Volume | 90 | 90 |
| Sheath Volume | 10 | 10 |
| Total wt % of UV Absorbing Agent | 1.0 | 0.5 |
| Wt % of UV Absorbing Agent in Sheath | 10.0 | 5.0 |
| Wt % of UV Absorbing Agent in Core | 0 0 | 0 0 |
| % Tenacity Retention after 400 hrs UV | 48 7 | 41 5 |

Thus, it should be appreciated that while the total amount of the UV agent can be decreased by more than 66%, the percent tenacity retention decreases only by less than 10% (see e.g., Fiber 6 of Table 2 and Fiber 1 of Table 1) due to a reduction in sheath thickness.

The retention of tenacity was measured using the standard procedure for determination of deterioration in tensile strength of geotextiles by exposure to ultraviolet light and water as described in ASTM-D4355 (American Society for Testing and Materials (1999), West Conshohocken, Pa.). The fibers were spun using a protocol as follows:

The Thin Sheath Fibers were produced using various polymers and polymer compounds as the sheath material and PET chips as the core material. For samples listed in Tables 1 through 3, the extrusion temperature for the sheath was set from 240° C. to 295° C. and the extrusion temperature for the core was set from 260° C. to 295° C. The spin block temperature was set at 295° C. Unless otherwise specified, the main process conditions are as following:

Total throughput per spinneret: 32 pound per hour; Number of filaments: 136; Take-up speed: 450 meter per minute; 1st draw roll temperature: 90° C.; 2nd draw roll temperature: 190° C.; Total draw ratio: 4.8; Target denier: 1000.

As can be clearly seen from Table 1, the desired physico-chemical property (here: retention of tenacity after UV exposure) increases as the sheath thickness decreases while the overall amount of the additive in the fiber remains constant. Similarly, as depicted in Table 2, the desired physico-chemical property (here: retention of tenacity after UV exposure) increases as the amount of the additive in the sheath increases while the sheath volume remains constant.

Viewed from another perspective, it should be recognized that fibers according to the inventive subject matter exhibit a JZ-coefficient $C_{JZ}$ (i.e., a modified UV-resistance coefficient) of at least 1.0, preferably at least 1.3, more preferably at least 1.6, even more preferably at least 2.9, and most preferably at least 4.9.

$$C_{JZ}=R/\{[B]\times[S]\times(\epsilon\times10^{-3})\}$$

wherein R is the percentage of retention of tenacity after 400 hrs of UV irradiation as described above, [B] is the concentration of additive in wt % in the sheath, [S] is the sheath-to-core ratio, and $\epsilon$ is the molar extinction coefficient of the additive at an absorption maximum in the range of 230 nm to 280 nm. For example, the fibers 1–3 according to Table 1 exhibit a $C_{JZ}$ of 1.0, 1.34, 1.68, respectively. In a further example, the fibers 5–6 in Table 2 exhibit a $C_{JZ}$ of 2 92 and 4.98, respectively (calculated with an approximate $\epsilon$ of 15.000 l/mol*cm for both cyclic iminoester in Table 2 and benzotriazole in Table 1).

Composition and Physico-chemical Properties of Thin Sheath Fibers with a Dye

The following fibers were spun from the compositions as indicated in Table 3, which also includes volume ratios and selected physico-chemical properties (here: positive difference in color intensity as measured in Delta E).

TABLE 3

| | Fiber 7 | Fiber 8 |
|---|---|---|
| Core Material | PET with IV of 0.87 | PET with IV of 0.87 |
| Sheath Material | PET with IV of 0.95 plus hunter green concentrate | PET with IV of 0 95 plus hunter green concentrate |
| Core Volume | 70 | 85 |
| Sheath Volume | 30 | 15 |
| Total wt % of dye | 0.5 | 0 5 |
| Wt % of dye in Sheath | 1 6 | 3.3 |
| Wt % of dye in Core | 0 0 | 0 0 |
| Average Dye take-up | 0 45 | 0.43 |
| Color Test L | 57.47 | 58 33 |
| Color Test Delta E | –/– | 2.5 |

As can be clearly seen for Table 3, the desired physico-chemical property (here: color intensity as measured in delta E) significantly increases as the sheath thickness decreases while the overall amount of the dye (as measured by average dye take-up) in the fiber remains constant. Spinning conditions were substantially identical to those described above.

Thus, it is generally contemplated that fibers according to the inventive subject matter will be especially useful where a particular physico-chemical property in a fiber is desired while adding only relatively minor amounts of additive to the fiber. For example, where the additive comprises a chromophore, contemplated fibers may be employed in all applications where colored or UV-resistant fibers are preferred. Especially contemplated applications include colored or UV-resistant yarns, fabrics, and cords, and products containing such yarns, fabrics, and cords (e.g., textiles for garments or upholstery). In a still further example, contemplated fibers and fiber products may be incorporated into natural (e.g., rubber) and/or synthetic polymers (e.g., organic resins) as reinforcing or structural materials.

Thus, specific embodiments and applications of high-strength thin sheath fibers have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A fiber comprising:

a core, and a sheath having a volume, wherein the sheath at least partially surrounds the core;

an additive disposed in the sheath and optionally in the core, the additive determining a desired physico-chemical parameter;

wherein the fiber is spun such that without increasing an amount of the additive in the fiber the desired physico-chemical parameter increases when the volume of the sheath decreases;

wherein the core and the sheath comprise a polymer having an intrinsic viscosity IV of at least 0.75;

wherein the additive comprises an ultraviolet-light (UV) absorbing agent and the desired physico-chemical parameter comprises retention of tenacity after UV irradiation; and wherein the UV absorbing agent is present in an amount of about 0.5 wt %, wherein the core and the sheath have a volume ratio of 90:10, and wherein the retention of tenacity after UV irradiation is no less than 41%.

2. The fiber of claim 1 wherein the physico-chemical parameter increases at least 10% when the volume of the sheath decreases 10%.

3. The fiber of claim 1 wherein the core polymer comprises poly(ethylene terephthalate).

4. The fiber of claim 1 wherein the sheath polymer comprises poly(ethylene terephthalate).

5. The fiber of claim 1 wherein the sheath and core polymers comprise poly(ethylene terephthalate).

6. The fiber of claim 1 wherein the sheath comprises a polymer suitable for extrusion at a temperature of between 240° C. and 295° C.

7. The fiber of claim 1 wherein the core polymer comprises a polymer suitable for extrusion at a temperature of between 260° C. to 295° C.

8. A fiber comprising:

a core, and a sheath having a volume, wherein the sheath at least partially surrounds the core;

a UV absorbing chromophore disposed in the sheath and optionally in the core, wherein the chromophore increases retention of tenacity after UV irradiation;

wherein the core and the sheath have a volume ratio of between 80:20 and 95:5, and wherein the core and the sheath comprise a polymer having an intrinsic viscosity IV of at least 0.9;

wherein the chromophore is present in an amount of equal or less than 1.5 wt % of the fiber, and wherein the retention of tenacity after UV irradiation is no less than 45%; and wherein at least one of the core and the sheath polymers comprise poly(ethylene terephthatalate).

9. The fiber of claim 8 wherein the core and the sheath have a volume ratio of at least 90:10.

10. The fiber of claim 8 wherein the intrinsic viscosity IV is at least 1.0.

11. The fiber of claim 8 wherein the chromophore comprises a benzotriazole or a cyclic iminoester.

12. The fiber of claim 8 wherein the sheath comprises a polymer suitable for extrusion at a temperature of between 240° C. and 295° C.

13. The fiber of claim 8 wherein the core polymer comprises a polymer suitable for extrusion at a temperature of between 260° C. to 295° C.

* * * * *